United States Patent [19]

Previdi

[11] Patent Number: 4,964,176

[45] Date of Patent: Oct. 23, 1990

[54] LEG RAIN PROTECTOR

[76] Inventor: Robert Previdi, 30 La Farge La., Manhasset, N.Y. 11030

[21] Appl. No.: 474,502

[22] Filed: Feb. 2, 1990

[51] Int. Cl.[5] ..... A41D 27/12; A41D 17/00

[52] U.S. Cl. ..... 2/242; 2/46; 2/22; 2/23

[58] Field of Search ..... 2/242, 61, 46, 59, 22, 2/23

[56] References Cited

U.S. PATENT DOCUMENTS

| | | | |
|---|---|---|---|
| 185,923 | 1/1877 | Howard et al. | 2/46 |
| 536,697 | 4/1895 | Jacobs | 2/46 |
| 1,106,375 | 8/1914 | Girean | 2/242 |
| 1,527,825 | 2/1925 | Baggerud | 2/46 |
| 1,580,453 | 4/1926 | Stentiford | 2/46 |
| 2,075,760 | 3/1937 | Hesse | 2/242 |
| 2,429,507 | 10/1947 | Ballenger | 2/46 |
| 3,424,153 | 1/1969 | Lewis, Jr. | 2/242 |

FOREIGN PATENT DOCUMENTS

| | | | |
|---|---|---|---|
| 2626446 | 1/1988 | France | 2/46 |

*Primary Examiner*—Werner H. Schroeder
*Assistant Examiner*—Gloria Hale
*Attorney, Agent, or Firm*—Eliot S. Gerber

[57] ABSTRACT

A disposable device protects the bottom portions of trouser legs during rain or snowstorms. The device has two flexible plastic sheets, each sheet being rectangular and having an adhesive band, on one face, along its four edges. The adhesive band, before use of the device, is covered by a protective strip.

4 Claims, 1 Drawing Sheet

LEG RAIN PROTECTOR

BACKGROUND OF THE INVENTION

1. Field of the Invention

The present invention relates to disposable devices for protecting the bottom portions of trouser legs from becoming wet during rain or snowstorms.

2. Discussion of Relevant Art

At the present time people generally protect themselves from becoming wet when it rains by using an umbrella and a raincoat. The umbrellas may be relatively small, so that they may be folded and conveniently carried. The small size of the unbrella, however, results in rain wetting the portions of the user's trouser legs which extend below the raincoat.

There are also presently available various types of boots which protect the bottom portion of the user's legs. For example, heavy boots may be used during snowstorms. There are also available light-weight rubber boots which may be worn over the user's shoes and which extend in some cases as high as the user's knee. These boots are relatively heavy and/or cumbersome, so that they are frequently not carried on the person. Consequently, when it rains, they are often not available.

If the rainfall is heavy or if the wind is blowing or if there are puddles on the street, the rain or puddles may reach the portion of the user's trouser legs which extend below the user's raincoat. The pants frequently become wet, if not drenched, with water. If the pants are made of wool, they dry slowly and may have an unpleasant odor while drying.

OBJECTIVES AND FEATURES OF THE INVENTION

It is an objective of the present invention to provide a relatively inexpensive device to protect the portions of the user's trouser legs which extend below the raincoat from rain or the splashing from puddles.

It is a further objective of the present invention to provide such a device which is very light-weight and small in size so that it may be carried in a pocket or briefcase.

It is a further objective of the present invention to provide such a device which is sufficiently low in cost so that it may be provided as a disposable item for the convenience of the users and may be provided as gifts by hotels, restaurants or other places of public accommodation.

It is still a further objective of the present invention that the device may be readily applied to the bottom of the user's trouser legs and readily removed therefrom after usage and yet will completely protect that portion of the user's trouser legs from becoming wet due to precipitation or the splashing from puddles.

SUMMARY OF THE INVENTION

In accordance with the present invention there is provided a device to protect the bottom portion of the user's trouser legs which extend below the raincoat or other coat. This protection is particularly useful during rain or snowstorms and to protect the trouser legs from becoming wet from the splashing of puddles on the street.

The device consists of two flat sheets of flexible plastic film. The sheets are formed exactly the same and preferably are folded and placed in a container; for example, the container may be a plastic resin bag.

Each sheet is of a sufficient size to be wrapped around the bottom portion of the user's trouser legs. Each of the sheets has an adhesive strip along four contiguous edges on the inner face of the sheet. The adhesive is sufficient to adhere the sheet to itself and other materials, and yet permits its ready removal after use, for example, after the storm is over. The adhesive strips are covered by a fexible strip of non-adhesive sheet material, preferably colored paper or plastic tape.

In use, the user will remove the covering strips from each of the two sheets. He will then wrap the sheets just below the knee and extending several inches beyond the trouser cuffs, and commence to first adhere the adhesive strip to the trouser leg; then adhere the adhesive strip to the underlying plastic sheet; then fold the plastic sheet trouser cuff extension and adhere it to the inside of the trouser; and finally adhere the adhesive strip at the top (below the knee area). In effect, the adhered sheets would form cylinders. The cylinders will be sufficiently tight on the user's pants and adherent thereto so that they will stay up. These tubular sheets form a complete tube which prevents the entry of water. Consequently, they protect against rain, snow, sleet or the splashing from puddles. When the precipitation is over, or when the user has entered a protected area, he will remove the formed cylindrical sheets by pulling on the outer loose edges. He can then either dispose of the sheets or, if desired, reapply the protective covering strips and store the sheets in a personally convenient place.

BRIEF DESCRIPTION OF THE DRAWINGS

Other objectives and features of the present invention will be apparent from the following detailed description which should be taken in conjunction with the accompanying drawings.

In the drawings.

DETAILED DESCRIPTION OF THE INVENTION

Figure 1:
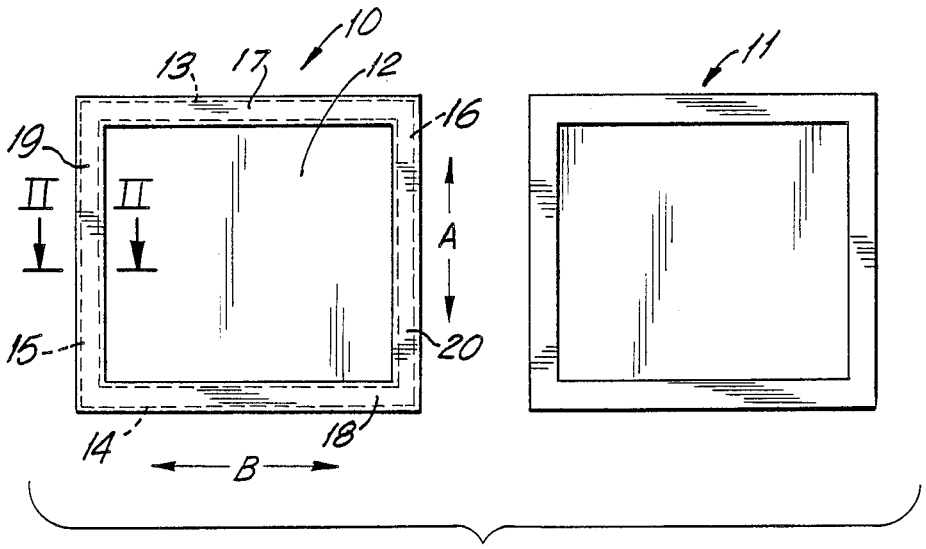
FIG. 1 is a front plan view of the sheets constituting the protective device of the present invention.

As shown in FIG. 1, the device of the present invention consists of two rectangular sheets 10 and 11. The sheets are preferably formed exactly alike. Each of the sheets 10 and 11 is formed of a thin flexible plastic resin film, for example, of biodegradable plastic or polyethylene and each has an inner and an outer face.

The inner face 12 of the sheet 10 has four contiguous self-adhesive strips adhered thereto. The sheet 10 is an elongated rectangular sheet which is preferably about 16 inches in height and 18 inches in width, the height being indicated by arrow A and the width by arrow B. The adhesive strip 13 runs along the top of the sheet 12; the adhesive strip 14 runs along the bottom of the sheet 12; the adhesive strip 15 runs along one side and the adhesive strip 16 runs along the other side of the sheet 12. Each of the adhesive strips is preferably about ¾-inch in width and has a ¼-inch border separating the strip from the edge of the sheet.

Each of the self-adhesive strips 13, 14, 15 and 16 is covered by a removable flexible strip, respectively strip portions 17, 18, 19 and 20. These removable strips are non-adhesive and formed from colored waxed paper or a suitable plastic tape. Preferably the non-ahdesive strips are about ¼-inch wider than the self-adhesive strips they cover.

Figure 2:
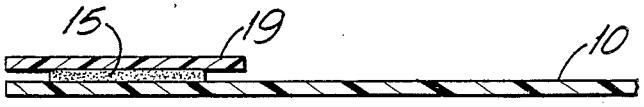
FIG. 2 is a greatly enlarged side sectional view taken along the lines 11—11 of FIG. 1.

As shown in FIG. 2, the sheet 10 along its side edge has adhesive strip 15 which is covered by the removable cover sheet 19.

Figure 3:
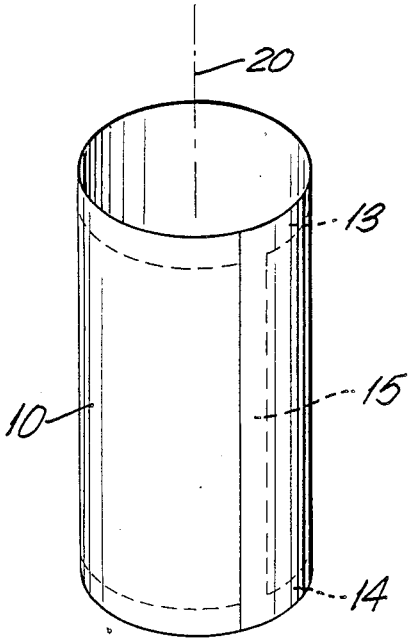
FIG. 3 is a perspective view of one sheet of the device rolled onto itself to form a protective cylinder.

As shown in FIG. 3, to wear the user removes the sheets 10 and 11 from the container (not shown) and flattens the sheets. He then removes the cover strip portions 17, 18, 19 and 20 from the respective self-adhesive strips 13, 14, 15 and 16. The strips 13–16 are sufficiently adhesive to stick to the outer face of the sheet and to the trouser leg, with the lower edge of the plastic sheet extending 2–3 inches beyond the trouser cuff, and the top edge just below the knee area. He then adheres the vertical side edge strip 15 to his pants leg and wraps the sheet 10 around the pants leg with the adhesive strips facing inwardly, i.e., towards the imaginary axis 20, and adheres the overlapped portion of the sheet 10. The lower edge of the sheet is then tucked within the trouser leg and the bottom self-adhesive strip adhered to the inner surface of the trouser leg. He then adheres, by pressure, the adhesive strips of the top edge to his pants leg. This forms a cylinder which completely protects the bottom portion of the user's leg against becoming wet from rain, snow, sleet or splashing from puddles. When the precipitation is over, the user pulls off the plastic sheets and discards them.

Modifications may be made in the present invention within the scope of the subjoined claims. For example, instead of being discrete sheets, they may be on a continuous roll which the user snaps off at regular perforated intervals.

What is claimed is:

1. A protection device to protect the lower trouser leg portions from becoming wet in precipitation, comprising two fexible sheets;

each sheet comprising a rectangular sheet having inner and outer faces, an adhesive band means adhered to said inner face along four edges thereof and adherable to said outer face and to textile material;

a flexible protective strip means covering said adhesive band to be removed from the adhesive band means when the sheet is used, wrapping the sheet around the lower trouser leg portion.

2. A protection device as in claim 1 wherein said sheets are plastic resin films.

3. A protection device as in claim 1 wherein the protective cover strip means is colored.

4. The method of protecting the lower trouser portions of a person from becoming wet during precipitation comprising:

(a) removing two flexible sheets from a container; each sheet being a rectangular sheet having inner and outer faces, an adhesive band means adhered to each of said inner faces along four edges thereof which is adherable to said outer face and consists of top, bottom and two opposite side strip portions, and a flexible cover strip means covering said adhesive band;

(b) pulling the cover strip means from the adhesive bands;

(c) wrapping the sheets to form protective tubes about the lower trouser leg portions by adhering the side portions of each sheet to the trouser leg and to the overlapped outer face thereof, folding the bottom portion of the sheet within the trouser leg and adhering the upper strip to the trouser leg below the knee.

* * * * *